US012560034B2

(12) United States Patent
Saponja et al.

(10) Patent No.: US 12,560,034 B2
(45) Date of Patent: Feb. 24, 2026

(54) ROD GUIDE CONFIGURATIONS FOR SUCKER ROD PUMPS

(71) Applicant: Oilify Sucker Rod Inc., Calgary (CA)

(72) Inventors: Jeffrey Charles Saponja, Invermere (CA); Robbie Singh Hari, Calgary (CA); Justin Bentsen, Calgary (CA)

(73) Assignee: Oilify New-tech Solutions Inc., Invermere (CA)

( * ) Notice: Subject to any disclaimer, the term of this patent is extended or adjusted under 35 U.S.C. 154(b) by 0 days.

(21) Appl. No.: 18/929,020

(22) Filed: Oct. 28, 2024

(65) Prior Publication Data

US 2025/0137331 A1 May 1, 2025

Related U.S. Application Data

(60) Provisional application No. 63/593,394, filed on Oct. 26, 2023.

(51) Int. Cl.
*E21B 17/04* (2006.01)
*E21B 17/10* (2006.01)

(52) U.S. Cl.
CPC ..... *E21B 17/1071* (2013.01); *E21B 17/04* (2013.01)

(58) Field of Classification Search
CPC ..... E21B 17/1071
See application file for complete search history.

(56) References Cited

U.S. PATENT DOCUMENTS 6,808,019 B1 * 10/2004 Mabry ..... E21B 37/02 166/176
9,200,489 B1 12/2015 Mabry
11,293,267 B2 * 4/2022 Boyd ..... E21B 37/045
2006/0201670 A1 9/2006 Stewart
2020/0165881 A1 * 5/2020 Nommensen ..... E21B 17/1078

FOREIGN PATENT DOCUMENTS

CN 108843256 * 11/2018 ..... E21B 17/10

OTHER PUBLICATIONS

CN108843256 (Year: 2018).*

* cited by examiner

*Primary Examiner* — Cathleen R Hutchins
(74) *Attorney, Agent, or Firm* — Smart & Biggar LP

(57) ABSTRACT

A conveyor for a sucker rod pump, for deployment downhole within a passage defined by an inner surface of a reservoir fluid conductor that is emplaced within a wellbore extending into a subterranean formation, for effecting production of reservoir fluids, comprising. The conveyor includes a rod configuration, and a guide configuration. The guide configuration is coupled to the rod configuration, and is defined by at least one protuberance. The protuberance defines an air foil shape.

20 Claims, 5 Drawing Sheets

ROD GUIDE CONFIGURATIONS FOR SUCKER ROD PUMPS

CROSS REFERENCE TO RELATED APPLICATIONS

This application claims priority from U.S. Provisional Application No. 63/593,394, filed Oct. 26, 2023, entitled ROD GUIDE CONFIGURATIONS FOR SUCKER ROD PUMPS, the contents of which are incorporated by reference herein below in their entirety.

FIELD

The present disclosure relates to rod guide configurations for sucker rod pump, including, rod guide configurations for composite rods employed within sucker rod pumps.

BACKGROUND

Sucker rods which employ composite rods are susceptible to inadequate rod fall, owing to their relatively low density. It is desirable to mitigate resistance, from reservoir fluid, to rod fall.

SUMMARY

In one aspect, there is provided a conveyor for a sucker rod pump, for deployment downhole within a passage defined by an inner surface of a reservoir fluid conductor that is emplaced within a wellbore extending into a subterranean formation, for effecting production of reservoir fluids, comprising:

a rod configuration;

a guide configuration, coupled to the rod configuration, and defined by at least one protuberance;

wherein:

each one of the at least one protuberance, independently, projects radially from the rod configuration; and for each one of the at least one protuberance, independently, relative to a reference fluid, a ratio of a first drag co-efficient, of the protuberance, measured in a direction of movement of the protuberance, relative to the reference fluid, in an upwardly direction, to a second drag co-efficient, of the protuberance, measured in a direction of movement of the protuberance, relative to the reference fluid, in a downwardly direction, is at least ten (10).

In another aspect, there is provided a conveyor for a sucker rod pump, for deployment downhole within a passage defined by an inner surface of a reservoir fluid conductor that is emplaced within a wellbore extending into a subterranean formation, for effecting production of reservoir fluids through a flow-conducting passage defined within the reservoir fluid conductor, comprising:

a rod configuration;

a guide configuration, coupled to the rod configuration, and defined by at least one protuberance;

wherein:

each one of the at least one protuberance, independently, projects radially from the rod configuration; and each one of the at least one protuberance, independently, defines an air foil shape, wherein the air foil shape includes a wider portion and a narrower portion, and is oriented such that the wider portion, of the air foil shape, is spaced apart, relative to the narrower portion, of the air foil shape, in a direction of upwardly movement of the conveyor, and such that the narrower portion, of the air foil shape, is spaced apart from the wider portion, of the air foil shape, in a direction of downwardly movement of the conveyor In another aspect, there is provided a conveyor for a sucker rod pump, for deployment downhole within a passage defined by an inner surface of a reservoir fluid conductor that is emplaced within a wellbore extending into a subterranean formation, for effecting production of reservoir fluids through a flow-conducting passage defined within the reservoir fluid conductor, comprising:

a rod configuration;

a guide configuration, coupled to the rod configuration, and including a protuberance configuration defined by at least one protuberance, wherein each one of the at least one protuberance, independently, projects radially from the rod configuration;

wherein:

the rod configuration is co-operable with the reservoir flow conductor such that, while the conveyor is emplaced within the reservoir flow conductor, the rod configuration is spaced apart, relative to the inner surface of the reservoir flow conductor, such that, within a cross-section of the conductor passage, within which the protuberance configuration, is disposed, an annular space is defined within the cross-section of the conductor passage of the reservoir fluid conductor, and the annular space defines a cross-section of the flow-conducting passage, through which the reservoir fluid is conducted within the reservoir flow conductor, such that a total cross-sectional flow area is defined by the annular space within the cross-section of the conductor passage; and a ratio of the total cross-sectional flow area, of the flow-conducting passage, within the cross-section, to a total cross-sectional area, of the conductor passage, within the cross-section, is greater than 0.89

BRIEF DESCRIPTION OF DRAWINGS

The embodiments will now be described with reference to the following accompanying drawings, in which.

DETAILED DESCRIPTION

Figure 1:
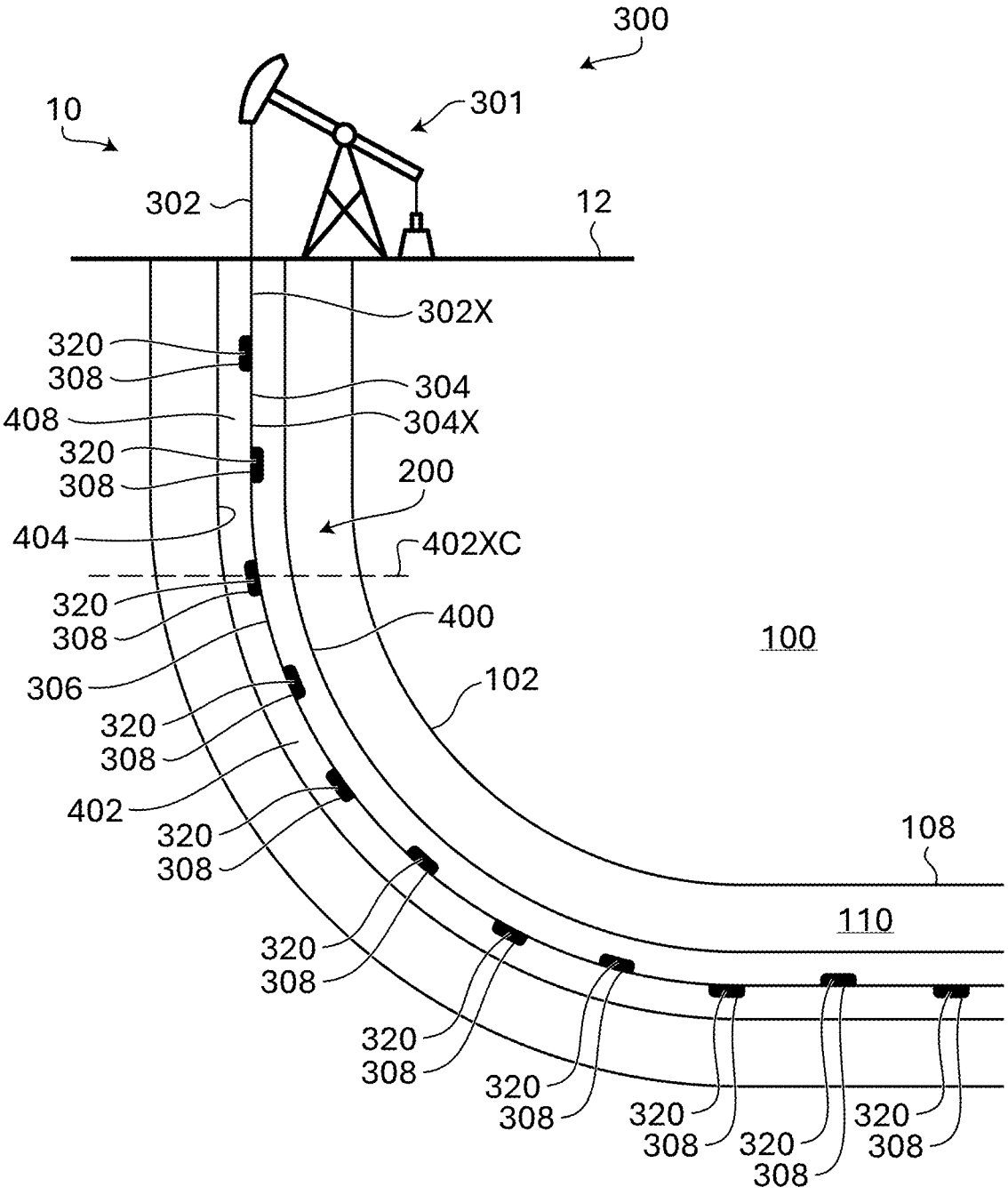
FIG. 1 is a schematic illustration of a system of the present disclosure.

Referring to FIG. 1, there is provided a rod pump 300 for integration within a reservoir fluid production assembly 200 of a system 10 for producing hydrocarbon material from a reservoir within a subterranean formation 100 via a wellbore 102 extending into the subterranean formation 100 from the earth's surface 12. The reservoir fluid production assembly 200 is disposed within a wellbore string passage 110 of a wellbore string 108 (e.g. casing) that is disposed within the wellbore 102. The reservoir fluid production assembly 200 includes a reservoir fluid conductor 400 for conducting reservoir fluid, that enters the wellbore 102 from the subterranean formation 100, to the surface 12.

The rod pump 300 includes a conveyor 302, and the conveyor 302 incudes a rod configuration 304. The rod configuration 304 is defined by at least one rod 306. In some embodiments, for example, the rod configuration 304 is defined by a single rod 306 only. In some embodiments, for example, the rod configuration 304 is defined by a plurality of rods 306, connected end to end, such that the conveyor 302 includes a rod string. The conveyor 302 defines a longitudinal axis 302X.

The conveyor 302 extends through a conductor passage 402 defined by an inner surface 404 of the reservoir fluid conductor 400 of the assembly 200. In some embodiments, for example, the reservoir fluid conductor 400 is a production string.

The conveyor 302 is connected to surface equipment which causes reciprocating movement of the conveyor 302. In some embodiments, for example, the surface equipment includes a prime mover (e.g. an internal combustion engine or a motor), a crank arm, and a beam. The prime mover rotates the crank arm, and the rotational movement of the crank arm is converted to reciprocal longitudinal movement through the beam. In some embodiments, for example, the prime mover is a pumpjack 301. The beam is attached to the conveyor by cables hung from a horsehead at the end of the beam. The conveyor passes through a stuffing box and is attached to the conveyor 302. Accordingly, the surface equipment effects reciprocating longitudinal movement of the conveyor 302, and further defines the upper and lower displacement limits of the conveyor 302. Reservoir fluid is produced to the surface in response to movement (e.g. an upstroke or downstroke) of the conveyor 302, by the pumpjack, along a longitudinal axis of the flow conductor 400.

In some embodiments, for example, for each one of the at least one rod 306, independently, the material of construction is composite material, such that the rod 306 is a composite rod. In some embodiments, for example, the composite rod includes a plurality of fibres that are embedded within a matrix material. In some embodiments, for example, the plurality of fibres is a plurality of continuous fibres. In some embodiments, for example, the plurality of fibres is a plurality of chopped fibres. In some embodiments, for example, the matrix material is in the form of a continuous phase of matrix material. In some embodiments, for example, the matrix material is in the form of a dispersed phase that is distributed through the composite rod. In some embodiments, for example, the matrix material is a polymeric material. In some embodiments, for example, the polymeric material is a thermoplastic material. In some embodiments, for example, the thermoplastic material is at least one of: a polyamide, a polyimide, sulfonated polymers, or any other high temperature thermoplastic. Suitable examples of sulfonated polymers includes polyphenylene sulfide (PPS) and polyetheretherketone (PEEK). Other suitable example of a thermoplastic polymer is a polyketone, such as, for example, polyketones obtained from the polymerization of carbon monoxide and one or more olefins (e.g. ethylene or propylene).

In some embodiments, for example, the diameter of the passage 402 defined by the reservoir conductor 400 is from two (2) inches to four (4) inches, and the conveyor 302, in some of these embodiments, for example, has a diameter of one-half (½) inch to one (1) inch.

The conveyor 302 further includes a guide configuration 308 for guiding the reciprocating movement of the conveyor 302 through the reservoir fluid conductor 400, along a longitudinal axis of the flow conductor 400. In some embodiments, for example, the conveyor 302, the rod configuration 304, the reservoir fluid conductor 400, and the guide configuration 308 are co-operatively configured such that, while the reciprocating movement of the conveyor 302 is being motivated (for example, by the pumpjack) along a longitudinal axis of the flow conductor 400, the rod configuration 304 is spaced-apart from the reservoir fluid conductor 400 by the guide configuration 308. In this respect, the guide configuration 308 prevents contact, or at least mitigate unacceptable contact, between the rod configuration 304 and the flow conductor 400. In some embodiments, for example, the conveyor 302, the reservoir fluid conductor 400, and the guide configuration 308 are further co-operatively configured such that, while the reciprocating movement of the conveyor 302 is motivated (for example, by the pumpjack), the guide configuration 308 scrape debris from the inner surface 404 of the reservoir fluid conductor 400.

In some embodiments, for example, the material of construction of the guide configuration 308 is polymeric material, such as, for example, plastic material.

In some embodiments, for example, the guide configuration 308 is configured for emplacement, during movement of the conveyor 302, close to the inner surface 404 of the flow conductor 400, but to be of slightly smaller diameter, so that the conveyor 302 can be freely reciprocated within the flow conductor without imposing significant restriction on the movement of the conveyor 302. In some embodiments, for example, the guide configuration 308 is disposed in close proximity to inner surface 404 so as to scrape away or dislodge paraffin or other encrustation to thereby mitigate formation of a blockage to reservoir fluid flow.

Figure 3:
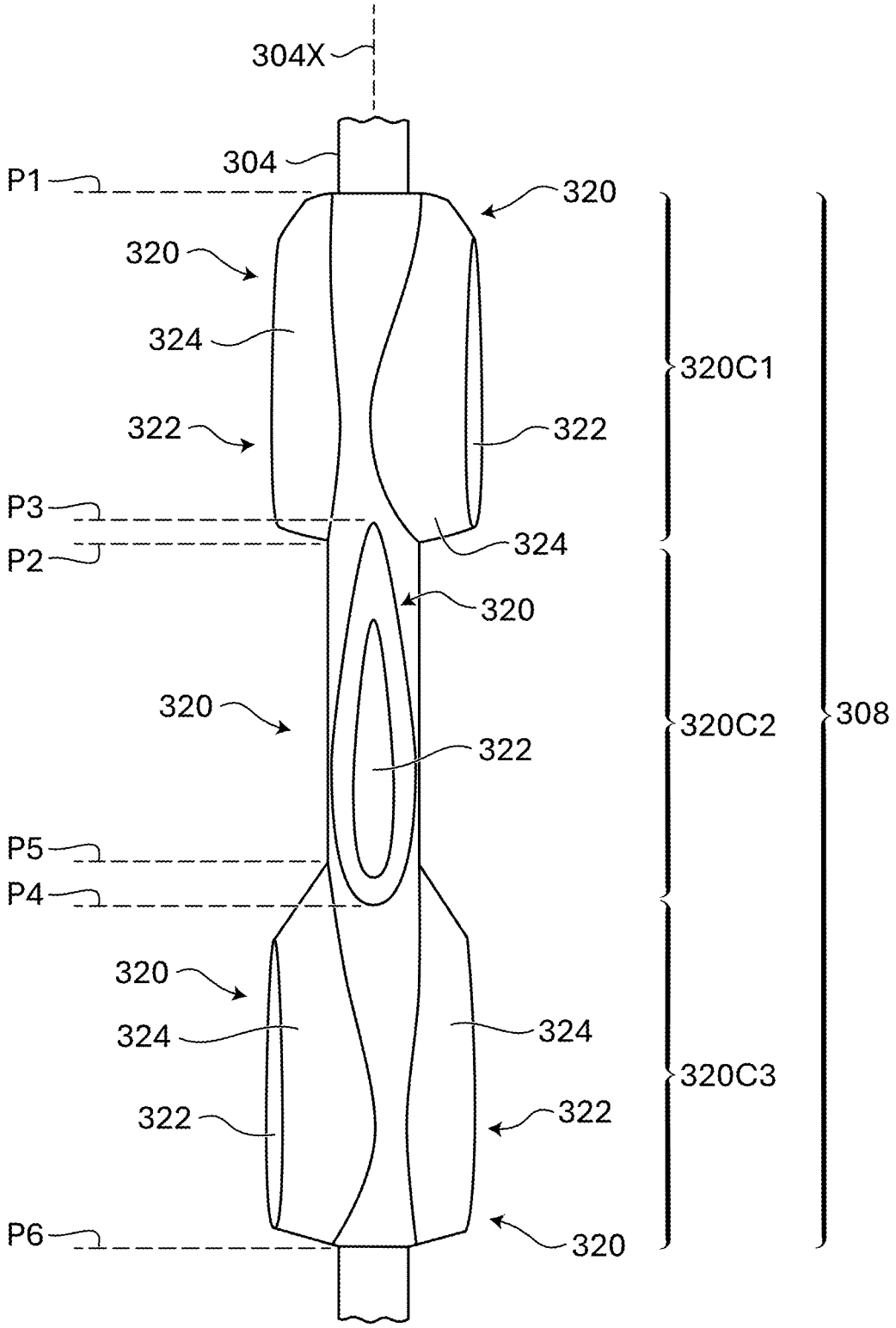
FIG. 3 is a schematic illustration of a section of the conveyor of another embodiment of the present disclosure.
Figure 4:
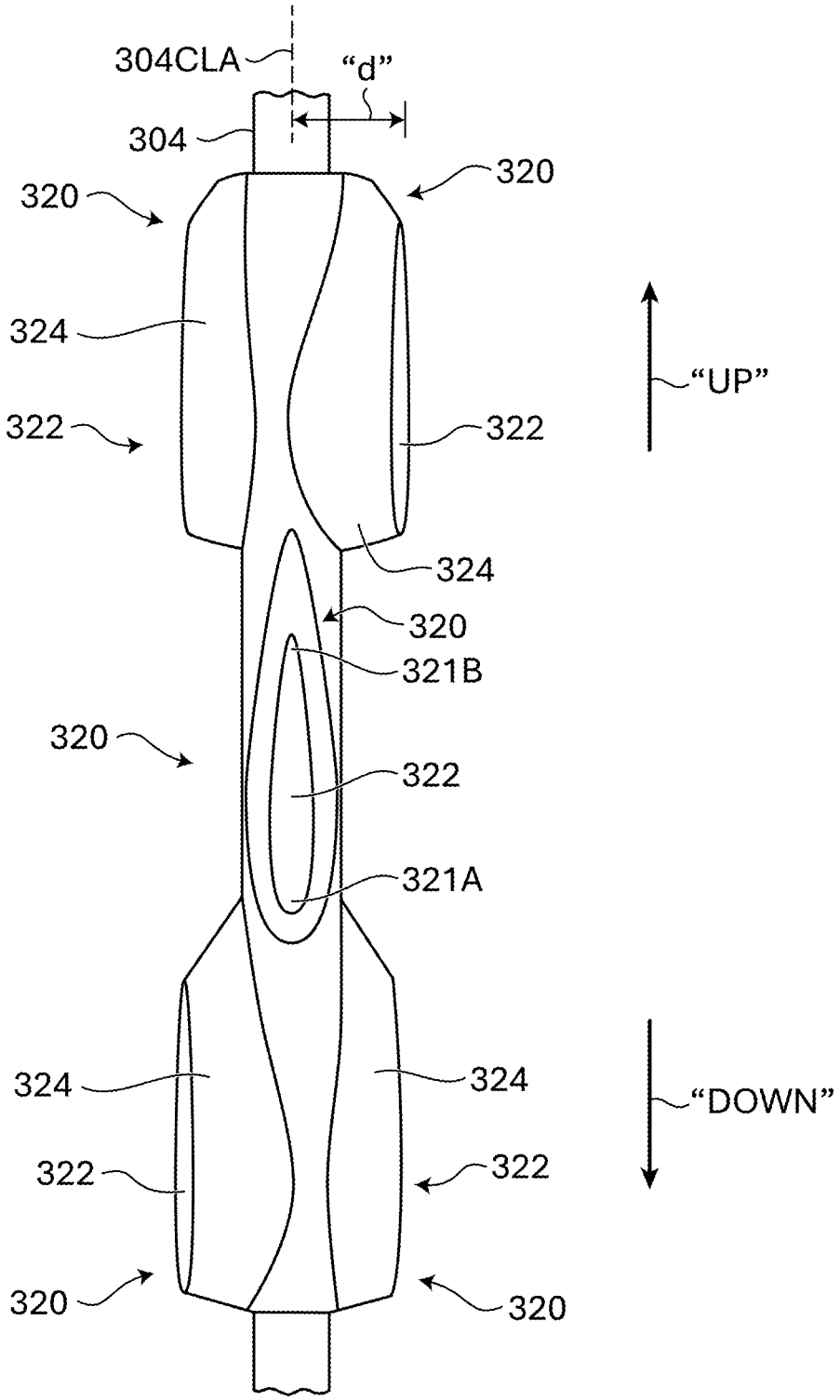
FIG. 4 is identical to FIG. 3, and illustrates directions of movement of the conveyor.

Referring to FIG. 3, the guide configuration 308 is defined by at least one protuberance 320. In some embodiments, for example, the guide configuration 308 is defined by at least one protuberance 320, only. In some embodiments, for example, each one of the at least one protuberance 320, independently, projects laterally (e.g. radially) from the rod configuration 304 of the conveyor 302. In some embodiments, for example, each one of the at least one protuberance, independently, is a rib. In some embodiments, for example, each one of the at least one protuberance, independently, is a lobe. In some embodiments, for example, each one of the at least one protuberance 320, independently, defines a respective outermost surface 322. Referring to FIG. 4, in some embodiments, for example, for each one of the at least one protuberance 320, independently, the protuberance projects laterally (e.g. radially) from the rod configuration 304 such that a minimum distance "d", from a respective central longitudinal axis 304CLA of the rod configuration 304, to the outermost surface 322 that is respective to the rod configuration 304, is at least 0.8 inch, such as, for example, at least 0.9 inch, such as, for example, at least 1.0 inch.

For each one of the at least one protuberance, independently, the outermost surface 322 is co-operable with the reservoir fluid conductor 400 such that, while the conveyor 302 is emplaced downhole within the reservoir fluid conductor 400, the outermost surface 322, that is respective to the protuberance 320, is disposed in opposition to the inner surface 404 of the reservoir flow conductor 400. In some embodiments, for example, the outermost surface 322, that is respective to the protuberance 320, defines a scraper (e.g. a blade, or a surface including abrasive particles) for the scraping away, or dislodging, of paraffin or other encrustation to thereby mitigate formation of a blockage to reservoir fluid flow.

Referring to FIG. 4, in some embodiments, for example, for each one of the at least one protuberance 320, independently, relative to a reference fluid, a ratio of a first drag coefficient, of the protuberance 320, measured in a direction of movement of the protuberance 320, relative to the reference fluid, in an upwardly direction, to a second drag coefficient, of the protuberance 320, measured in a direction of movement of the protuberance 320, relative to the reference fluid, in a downwardly direction, is at least five (10), such as, for example, at least ten (10), such as, for example, at least 12. In some of these embodiments, for example, for each one of the at least one protuberance 320, independently, relative to a reference fluid, a ratio of a first drag coefficient, of the protuberance 320, measured in a direction of movement of the protuberance 320, relative to the reference fluid, in an upwardly direction "UP", to a second drag coefficient, of the protuberance 320, measured in a direction of movement of the protuberance 320, relative to the reference fluid, in a downwardly direction "DOWN", is less than 15.

In some embodiments, for example, each one of the at least one protuberance 320, independently includes a respective side wall 324, disposed between the conveyor 302 and the outermost surface 322, that is respective to the protuberance 320, and the respective side wall 324 is configured in the form of an air foil shape. The air foil shape includes a wider portion 321A and a narrower portion 321B, and is oriented such that the wider portion, of the air foil shape, is spaced apart, relative to the narrower portion, of the air foil shape, in a direction of downwardly movement (e.g. downstroke) of the conveyor 302, and such that the narrower portion, of the air foil shape, is spaced apart from the wider portion, of the air foil shape, in a direction of upwardly movement (e.g. upstroke) of the conveyor 302 of the rod pump. In this respect, each one of the at least one protuberance 320, independently, is configured for co-operation with fluid within the flow passage 408 of the flow conductor 400 such that, while movement of the conveyor 302 is being motivated by a downstroke of the rod pump, the fluid flows across an inverted air foil shape of the protuberance 320.

In some embodiments, for example, the air foil shape is an air foil shaped-profile. In some embodiments, for example, the air foil shape is a teardrop shape, such as, for example, teardrop-shaped profile. In some embodiments, for example, the air foil shape is a Wortmann air foil shape. In some of these embodiments, for example, for each one of the at least one protuberance 320 of the guide configuration 308, independently, the shape, of the sidewall 324 of the protuberance 320, is characterized by a Fineness ratio of greater than three (3) and less than 20. In some of these embodiments, for example, for each one of the respective at least one protuberance 320 of the guide configuration 308, independently, the shape, of the side wall 324 of the protuberance 320, is characterized by a Fineness ratio of greater than three (3) and less than 15. In some of these embodiments, for example, for each one of the respective at least one protuberance 320 of the guide configuration 308, independently, the shape, of the side wall 324 of the protuberance 320, is characterized by a Fineness ratio of greater than three (3) and less than ten (10).

Referring to FIGS. 3 and 4, in some embodiments, for example, the guide configuration 308 is defined by a plurality of protuberance configurations 320C (in the illustrated embodiment, these are protuberance configurations 320C1, 320C2, and 320C3). The protuberance configurations are spaced apart along a longitudinal axis 304X of the rod configuration 304.

Each one of the protuberance configurations 320C, independently, is defined by a respective at least one protuberance 320. In some embodiments, for example, for each one of the protuberance configurations 320C, independently, each one of the at least one protuberance 320, that is respective to the protuberance configuration 320C, independently, is inscribed within a cylinder, and extends from a respective first plane, to which the longitudinal axis, of the rod configuration 304, is normal, to a respective second plane, to which the longitudinal axis, of the rod configuration 304, is normal. In the embodiment illustrated in FIG. 3, for example, three protuberance configurations 320C1, 320C2, 320C3 are illustrated, and the first protuberance configuration 320C1 extends from a first plane P1, to which the longitudinal axis 304X is normal, to a second plane P2, to which the longitudinal axis 304X is normal, and the second protuberance configuration 320C2 extends from a third plane P3, to which the longitudinal axis 304X is normal, to a fourth plane P4, to which the longitudinal axis 304X is normal, and the third protuberance configuration 320C3 extends from a fifth plane P5, to which the longitudinal axis 304X is normal, to a sixth plane P6, to which the longitudinal axis 304X is normal.

Figure 6:
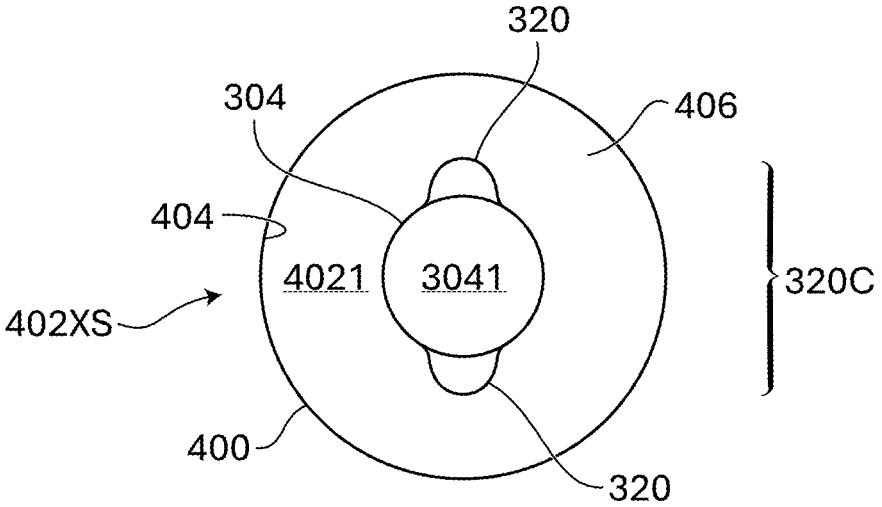
FIG. 6 is a schematic illustration of a sectional plan view of a conveyor of the present disclosure, taken along line 402XC in FIG. 1.

Referring to FIGS. 3, 4, and 6, in some embodiments, for example, for each one of the protuberance configurations 320C, independently, the at least one protuberance 320, that is respective to the protuberance configuration, is defined by a respective plurality of protuberances 320, and the respective plurality of protuberances 320 are spaced apart (and, in some embodiments, for example, circumferentially spaced apart) relative to one another. In some embodiments, for example, for each one of the protuberance configurations 320, independently, the relative spacing apart, of the plurality of protuberances 320, that are respective to the protuberance configuration 320, is symmetrical.

In the embodiments illustrated in FIGS. 3, 4, and 6, each one of the protuberance configurations 320C, independently, consists of a respective two (2) protuberances 320. Also with respect to the embodiments illustrated in FIGS. 3, 4, and 6, for each one of the protuberance configurations, independently, the protuberances 320, that are respective to the protuberance configuration, are radially spaced apart by 180 degrees.

Referring to FIGS. 3 and 4, in some embodiments, for example, the plurality of protuberance configurations 320C, are spaced apart, relative to one another, along a longitudinal axis 304X of the rod configuration 304, in series. Each one of the axially-spaced protuberance configurations 320C, independently, is spaced apart from one another along the longitudinal axis 304X of the rod configuration 304. In the embodiment illustrated in FIGS. 3 and 4, for example, the plurality of axially-spaced protuberance configurations 320C is three (3) axially-spaced protuberance configurations 320C1, 320C2, 330C3, in series. In some embodiments, for example, the plurality of axially-spaced protuberance configurations 320C is four (4) axially-spaced protuberance configurations 320C, in series. In some embodiments, for example, the plurality of axially-spaced protuberance configurations 320C is five (5) axially-spaced protuberance configurations 320C, in series. In some embodiments, for example, the plurality of axially-spaced protuberance configurations 320C is six (6) axially-spaced protuberance configurations 320C, in series. In some embodiments, for example, the plurality of axially-spaced protuberance configurations 320C is seven (7) axially-spaced protuberance configurations 320C, in series.

In some embodiments, for example, adjacent ones, of the axially-spaced protuberance configurations 320C, are offset relative to one another (i.e. there is an absence of alignment between one of the protuberance configuration 320C of an adjacent pair of protuberance configurations 320C and the other one of the adjacent pair of protuberance configurations 320C). In the embodiment illustrated in FIGS. 3 and 4, for example, adjacent ones, of the axially-spaced protuberance configurations 320C1, 320C2, and 320C3, are rotationally offset relative to one another.

Figure 2:
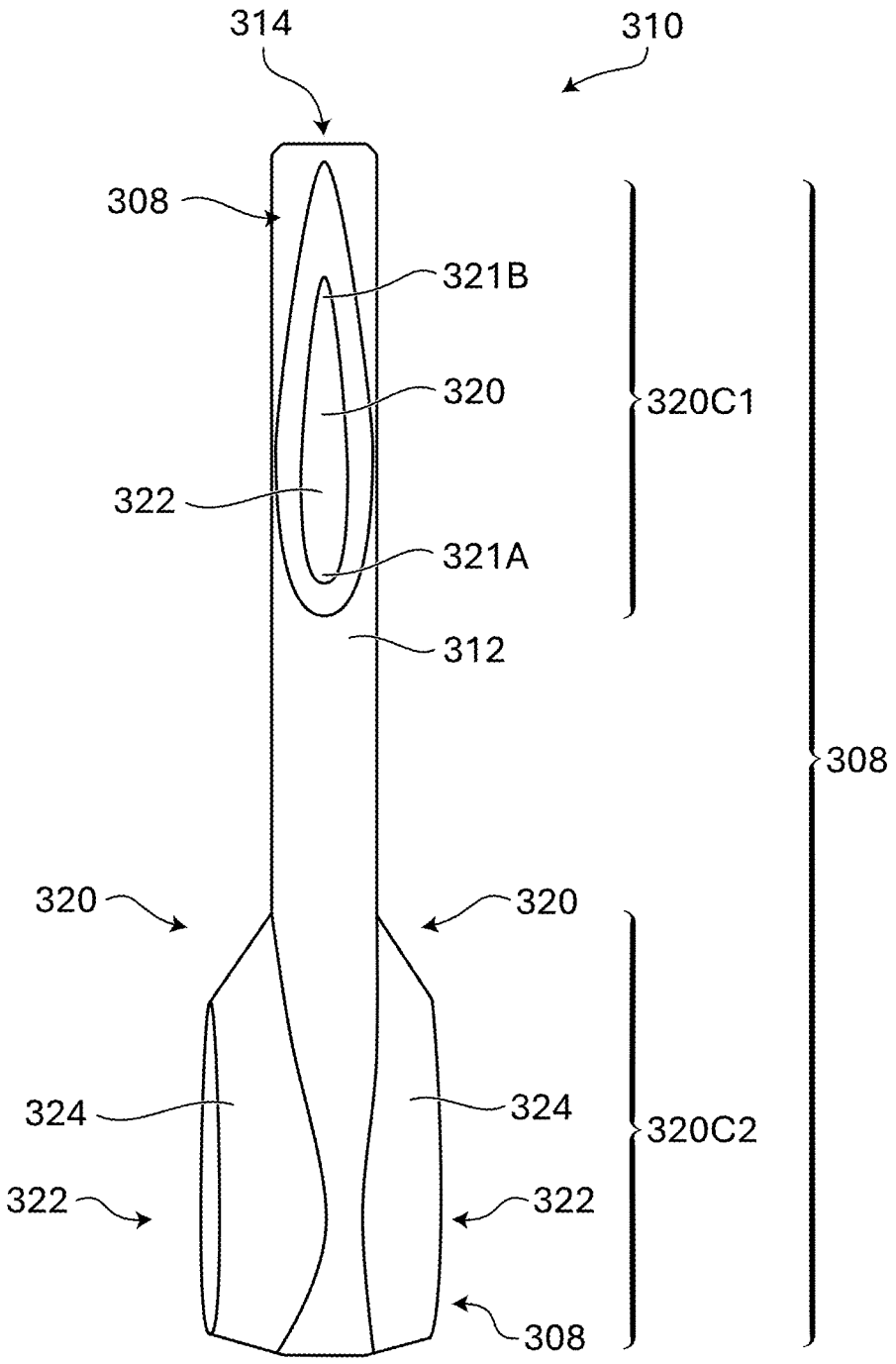
FIG. 2 is a schematic illustration of a rod guide of an embodiment of the present disclosure, for coupling to a rod configuration of a conveyor of the present disclosure.

Referring to FIG. 2, in some embodiments, for example, the guide configuration 308 is defined by a rod guide 310 for coupling to the rod configuration 304. The rod guide 310 includes a tubular portion 312 (e.g. sleeve) that defines a guide passage 314. For each one of the respective at least one protuberance 320 of the guide configuration 308, independently, the protuberance 320 extends laterally (e.g. radially) from the rod guide 310. In such embodiments, for example, the guide 310 is configured for coupling to the rod configuration 304 by insertion of the rod configuration 304 through the guide passage 314. In some embodiments, for example, a plurality of rod guides 310 are coupled, at spaced intervals, to the rod configuration 304, such that the plurality of rod guides 310 become emplaced in a series along the rod configuration 304. In some embodiments, for example, the coupling is effected via fusing. In some embodiments, for example, the coupling is effected via an adhesive.

Figure 5:
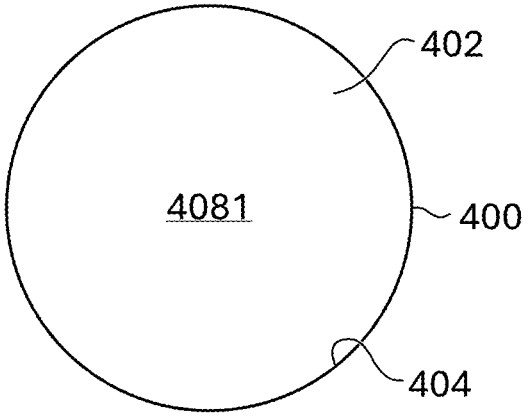
FIG. 5 is a schematic illustration of a sectional plan view of a reservoir flow conductor of the present disclosure, taken along line 402XC in FIG. 1.

Referring to FIGS. 1, 5, and 6, in some embodiments, for example, the rod configuration 304 is co-operable with the reservoir flow conductor 400 such that, while the conveyor 302 is emplaced within the conductor passage 402 such that a protuberance configuration 320C, of the rod configuration 304, is disposed within a cross-section 402XS of the conductor passage 402, the rod configuration 304 is spaced apart, relative to the inner surface 404 of the reservoir flow conductor 400, such that, an annular space 406 is defined within the cross-section 402XS of the conductor passage 402 of the reservoir fluid conductor 400. The annular space 406 defines a cross-section of the flow-conducting passage 408 through which the reservoir fluid is conducted within the reservoir flow conductor 400. In this respect, a total cross-sectional flow area 4021 is defined by the annular space 406 within the cross-section 402XS of the conductor passage 402.

Also, in some embodiments, for example, the emplacement, of the conveyor 302 within the conductor 400, such that a protuberance configuration 320C, of the rod configuration 304, is disposed within a cross-section 402XS of the conductor passage 402, and such that the spaced apart relationship between the rod configuration 304 and the inner surface 404 within the cross-section 402XS is established, is an emplacement effectuated while the conveyor 302 is being moved along a longitudinal axis within the conductor passage 402. In this respect, in some embodiments, for example, the rod configuration 304 is co-operable with the reservoir flow conductor 400 such that, while the conveyor 302 is being moved, along a longitudinal axis within the conductor passage 402, such that, during the movement, a protuberance configuration 320C, of the rod configuration 304, becomes disposed within a cross-section 402XS of the conductor passage 402, the rod configuration 304 is spaced apart, relative to the inner surface 404 of the reservoir flow conductor 400, such that, an annular space 406 is defined within the cross-section 402XS of the conductor passage 402 of the reservoir fluid conductor 400, and the annular space 406 defines a total cross-sectional flow area 4081 within the cross-section 402XS of the conductor passage 402 of the reservoir fluid conductor 400.

Referring to FIGS. 5 and 6, in some embodiments, for example, the ratio of the total cross-sectional flow area 4081, of the flow-conducting passage 408, within the cross-section 402XS, to the total cross-sectional area 4021, of the conductor passage 402, within the cross-section 402XS, is greater than 0.89, such as, for example, greater than 0.90, such as, for example, greater than 0.91, such as, for example, greater than 0.92, such as, for example, greater than 0.93. In other words, within the cross-section 402XS, the ratio of the total cross-sectional flow area 4081 of the flow-conducting passage 408 to the total cross-sectional area 4021 of the conductor passage 402 is greater than 0.89, such as, for example, greater than 0.90, such as, for example, greater than 0.91, such as, for example, greater than 0.92, such as, for example, greater than 0.93.

Referring again to FIGS. 5 and 6, in some embodiments, for example, within the cross-section 402XS, the ratio of the total cross-sectional area 3201C, of the protuberance configuration 320C, to the total cross-sectional area 3041, of the rod configuration 304, is less than 0.4, such as, for example, less than 0.35, such as, for example, less than 0.3, such as, for example, less than 0.25, such as, for example, less than 0.2, and, in some of these embodiments, for example, within the cross-section 402XS, the ratio of the total cross-sectional area 3081, of the protuberance configuration, to the total cross-sectional area 3041, of the rod configuration 304, is greater than 0.15.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

Although the embodiments have been described in detail, it should be understood that various changes, substitutions and alterations could be made herein.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

The invention claimed is:

1. A conveyor for a sucker rod pump, for deployment downhole within a passage defined by an inner surface of a reservoir fluid conductor that is emplaced within a wellbore extending into a subterranean formation, for effecting production of reservoir fluids, comprising:

a rod configuration;

a guide configuration coupled to the rod configuration;

wherein:

the guide configuration includes a first protuberance and a second protuberance;

each one of the first protuberance and the second protuberance, independently, projects radially from the rod configuration;

the projection of the first protuberance, relative to the projection of the second protuberance, is such that the first protuberance is disposed on an opposite side of the rod configuration relative to the second protuberance;

and for each one of the first protuberance and the second protuberance, independently, relative to a reference fluid, a ratio of a first drag co-efficient, of the protuberance, measured in a direction of movement of the protuberance in an upward direction, to a second drag co-efficient, of the protuberance, measured in a direction of movement of the protuberance in a downward direction, is at least ten (10).

2. The conveyor as claimed in claim 1;

wherein:

the first protuberance and the second protuberance are diametrically opposed.

3. The conveyor as claimed in claim 1;

wherein:

each one of the first protuberance and the second protuberance, independently, defines an air foil shape, wherein the air foil shape includes a wider portion and a narrower portion, and is oriented such that the wider portion, of the air foil shape, is spaced apart, relative to the narrower portion, of the air foil shape, in a direction of upward movement of the conveyor, and such that the narrower portion, of the air foil shape, is spaced apart from the wider portion, of the air foil shape, in a direction of downward movement of the conveyor.

4. The conveyor as claimed in claim 1;

wherein:

the material of construction of the rod configuration is a composite material.

5. The conveyor as claimed in claim 1;

wherein:

the rod configuration is co-operable with the reservoir fluid conductor such that, while the conveyor is emplaced within the reservoir fluid conductor, the rod configuration is spaced apart relative to the inner surface of the reservoir fluid conductor, such that, within a cross-section of a conductor passage of the reservoir fluid conductor, within which the protuberance configuration is disposed, an annular space is defined within the cross-section of the conductor passage of, and the annular space defines a cross-section of the conductor passage, through which the reservoir fluid is conducted within the reservoir fluid conductor, such that a total cross-sectional flow area is defined by the annular space within the cross-section of the conductor passage; and within the cross-section, a ratio, of a total cross-sectional area of the protuberance configuration to a total cross-sectional area of the rod configuration, is less than 0.4.

6. A conveyor for a sucker rod pump, for deployment downhole within a passage defined by an inner surface of a reservoir fluid conductor that is emplaced within a wellbore extending into a subterranean formation, for effecting production of reservoir fluids, comprising:

a rod configuration;

a guide configuration coupled to the rod configuration;

wherein:

the guide configuration includes a first protuberance and a second protuberance;

each one of the first protuberance and the second protuberance, independently, projects radially from the rod configuration;

the projection of the first protuberance, relative to the projection of the second protuberance, is such that the first protuberance is disposed on an opposite side of the rod configuration relative to the second protuberance;

and each one of the first protuberance and the second protuberance, independently, defines an air foil shape, wherein the air foil shape includes a wider portion and a narrower portion, and is oriented such that the wider portion, of the air foil shape, is spaced apart, from the narrower portion of the air foil shape, in a direction of upwardly movement of the conveyor, and such that the narrower portion, of the air foil shape, is spaced apart, from the wider portion, of the air foil shape, in a direction of downwardly movement of the conveyor.

7. The conveyor as claimed in claim 6;

wherein:

each one of the first protuberance and the second protuberance, independently, defines a respective outermost surface and a sidewall, wherein the sidewall is disposed between the rod configuration and the outermost surface;

for each one of the first protuberance and the second protuberance, independently, the outermost surface is co-operable with the reservoir fluid conductor such that, while the conveyor is emplaced downhole within the reservoir fluid conductor, the outermost surface, that is respective to the protuberance, is disposed in opposition to the inner surface of the reservoir fluid conductor; and for each one of the first protuberance and the second protuberance, independently, the air foil shape, in which form at least a portion of the protuberance is configured, is defined by the sidewall.

8. The conveyor as claimed in claim 6;

wherein:

the air foil shape is a teardrop-shaped profile.

9. The conveyor as claimed in claim 6;

wherein:

the at least a portion, of the protuberance, which is configured in the air foil shape, is characterized by a Fineness ratio of greater than three (3) and less than 20.

10. The conveyor as claimed in claim 6;

wherein:

the material of construction of the rod configuration is a composite material.

11. The conveyor as claimed in claim 6;

wherein:

the rod configuration is co-operable with the reservoir fluid conductor such that, while the conveyor is emplaced within the reservoir fluid conductor, the rod configuration is spaced apart relative to the inner surface of the reservoir fluid conductor, such that, within a cross-section of a conductor passage of the reservoir fluid conductor, within which the protuberance configuration is disposed, an annular space is defined within the cross-section of the conductor passage, and the annular space defines a cross-section of the conductor passage, through which the reservoir fluid is conducted within the reservoir fluid conductor, such that a total cross-sectional flow area is defined by the annular space within the cross-section of the conductor passage; and within the cross-section, a ratio, of a total cross-sectional area of the protuberance configuration to a total cross-sectional area of the rod configuration, is less than 0.4.

12. A conveyor for a sucker rod pump, for deployment downhole within a passage defined by an inner surface of a reservoir fluid conductor that is emplaced within a wellbore extending into a subterranean formation, for effecting production of reservoir fluids, comprising:

a rod configuration;

a guide configuration coupled to the rod configuration;

wherein:

the guide configuration includes a plurality of protuberances;

each one of the protuberances, independently, projects radially from the rod configuration, such that radially projecting from the rod configuration is the plurality of protuberances only;

and for each one of the protuberances, independently, relative to a reference fluid, a ratio of a first drag co-efficient, of the protuberance, measured in a direction of movement of the protuberance in an upward direction, to a second drag co-efficient, of the protuberance, measured in a direction of movement of the protuberance in a downward direction, is at least ten (10).

13. The conveyor as claimed in claim 12;

wherein:

each one of the protuberances, independently, defines an air foil shape, wherein the air foil shape includes a wider portion and a narrower portion, and is oriented such that the wider portion, of the air foil shape, is spaced apart, relative to the narrower portion, of the air foil shape, in a direction of upward movement of the conveyor, and such that the narrower portion, of the air foil shape, is spaced apart from the wider portion, of the air foil shape, in a direction of downward movement of the conveyor.

14. The conveyor as claimed in claim 12;

wherein:

the material of construction of the rod configuration is a composite material.

15. The conveyor as claimed in claim 12;

wherein:

the plurality of protuberances is defined by a plurality of axially-spaced protuberance configurations;

each one of the axially-spaced protuberances, independently, is defined by a pair of spaced apart protuberances of the plurality of protuberances;

and adjacent ones, of the protuberance configurations, are offset relative to one another.

16. A conveyor for a sucker rod pump, for deployment downhole within a passage defined by an inner surface of a reservoir fluid conductor that is emplaced within a wellbore extending into a subterranean formation, for effecting production of reservoir fluids, comprising:

a rod configuration;

a guide configuration coupled to the rod configuration;

wherein:

the guide configuration includes a plurality of protuberances;

each one of the protuberances, independently, projects radially from the rod configuration, such that radially projecting from the rod configuration is the plurality of protuberances only;

and each one of the protuberances, independently, defines an air foil shape, wherein the air foil shape includes a wider portion and a narrower portion, and is oriented such that the wider portion, of the air foil shape, is spaced apart, relative to the narrower portion of the air foil shape, in a direction of upward movement of the conveyor, and such that the narrower portion, of the air foil shape, is spaced apart from the wider portion, of the air foil shape, in a direction of downward movement of the conveyor.

17. The conveyor as claimed in claim 16;

wherein:

each one of the protuberances, independently, defines a respective outermost surface and a sidewall, disposed between the rod configuration and the outermost surface;

for each one of the protuberances, independently, the outermost surface is co-operable with the reservoir fluid conductor such that, while the conveyor is emplaced downhole within the reservoir fluid conductor, the outermost surface, that is respective to the protuberance, is disposed in opposition to the inner surface of the reservoir fluid conductor; and for each one of the protuberances, independently, the air foil shape, in which form at least a portion of the protuberance is configured, is defined by the sidewall.

18. The conveyor as claimed in claim 16;

wherein:

the air foil shape is a teardrop-shaped profile.

19. The conveyor as claimed in claim 16;

wherein:

the at least a portion, of the protuberance, which is configured in the air foil shape, is characterized by a Fineness ratio of greater than three (3) and less than 20.

20. The conveyor as claimed in claim 19;

wherein:

the material of construction of the rod configuration is a composite material.

* * * * *